US009556876B2

(12) United States Patent
Sano et al.

(10) Patent No.: US 9,556,876 B2
(45) Date of Patent: Jan. 31, 2017

(54) CENTRIFUGAL FLUID MACHINE

(71) Applicant: MITSUBISHI HEAVY INDUSTRIES, LTD., Tokyo (JP)

(72) Inventors: Takeshi Sano, Tokyo (JP); Shinji Fukao, Tokyo (JP); Koichi Ishizaka, Tokyo (JP); Kenichi Niu, Tokyo (JP); Yuya Fukuda, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 303 days.

(21) Appl. No.: 14/372,574

(22) PCT Filed: Jan. 10, 2013

(86) PCT No.: PCT/JP2013/050317

§ 371 (c)(1),
(2) Date: Jul. 16, 2014

(87) PCT Pub. No.: WO2013/111620

PCT Pub. Date: Aug. 1, 2013

(65) Prior Publication Data

US 2015/0016981 A1 Jan. 15, 2015

(30) Foreign Application Priority Data

Jan. 23, 2012 (JP) ..... 2012-011397

(51) Int. Cl.
*F04D 29/041* (2006.01)
*F04D 29/051* (2006.01)
(Continued)

(52) U.S. Cl.
CPC ..... *F04D 29/041* (2013.01); *F04D 1/00* (2013.01); *F04D 29/051* (2013.01);
(Continued)

(58) Field of Classification Search
CPC .. F04D 29/041; F04D 29/051; F04D 29/2266; F04D 29/2238; F04D 29/2255; F04D 29/28; F04D 29/284; F04D 1/00; F04D 17/08; F04D 17/10; F04D 17/16
(Continued)

(56) References Cited

U.S. PATENT DOCUMENTS 996,859 A * 7/1911 Keller ..... F04D 29/30 415/104
5,156,522 A * 10/1992 Tessier ..... F04D 29/167 415/170.1
2006/0263200 A1* 11/2006 Ahlroth ..... F04D 29/2266 415/58.2

FOREIGN PATENT DOCUMENTS

DE 44 00 633 7/1995
EP 1 574 718 9/2005
(Continued)

OTHER PUBLICATIONS

English machine translation of JP 2002-235,696, Aug. 2002.*
(Continued)

*Primary Examiner* — Christopher Verdier
(74) *Attorney, Agent, or Firm* — Wenderoth, Lind & Ponack, L.L.P.

(57) ABSTRACT

A centrifugal fluid machine includes an impeller (4) that has a front shroud (41) arranged on one side in an axial direction, a rear shroud (42) arranged on the other side in the axial direction, and a plurality of blades (43) provided side by side in a circumferential direction between the front shroud and the rear shroud and is rotatably supported within a casing (2); a suction passage (2A) that allows a fluid to be sucked therethrough in the axial direction toward the impeller with the rotation of the impeller; a discharge passage (2B) that allows a fluid delivered under pressure by the impeller with the rotation of the impeller to be discharged in a direction
(Continued)

intersecting the axial direction of the impeller; and a first flow path (5A) that communicates with the discharge passage, leads to the suction passage through a gap between the casing and the rear shroud, and an opening (5Aa) that opens toward the downstream side of the suction passage in a suction direction of a fluid. The opening area of the opening is set so that the ejection speed (Vs) of a fluid ejected from the opening to the suction passage is matched with the suction speed (V) of a fluid sucked into the suction passage.

2 Claims, 2 Drawing Sheets

(51) Int. Cl.
*F04D 29/22* (2006.01)
*F04D 1/00* (2006.01)

(52) U.S. Cl.
CPC ..... *F04D 29/2238* (2013.01); *F04D 29/2255* (2013.01); *F04D 29/2266* (2013.01)

(58) Field of Classification Search
USPC ..... 415/104, 106–107, 110–112, 58.2, 58.3, 415/58.4; 416/181
See application file for complete search history.

(56) References Cited

FOREIGN PATENT DOCUMENTS

| | | |
|---|---|---|
| JP | 182816 | 10/1956 |
| JP | 54-43606 | 3/1979 |
| JP | 57-89896 | 6/1982 |
| JP | S60-88896 | 5/1985 |
| JP | 63-016598 | 4/1988 |
| JP | 03-123999 | 12/1991 |
| JP | 11-166499 | 6/1999 |
| JP | 2002-235696 | 8/2002 |
| JP | 2007-085223 | 4/2007 |
| WO | 95/19503 | 7/1995 |
| WO | 2004/055380 | 7/2004 |

OTHER PUBLICATIONS

International Search Report issued Apr. 16, 2013 in International (PCT) Application No. PCT/JP2013/050317.
Written Opinion of the International Searching Authority issued Apr. 16, 2013 in International (PCT) Application No. PCT/JP2013/050317 with English translation.
Extended European Search Report issued Sep. 25, 2015 in corresponding European Patent Application No. 13740553.6.

* cited by examiner

CENTRIFUGAL FLUID MACHINE

TECHNICAL FIELD

The present invention relates to a centrifugal fluid machine used as a centrifugal pump or the like.

BACKGROUND ART

In the related art, a centrifugal fluid machine (axial thrust reducing device of a centrifugal pump) described in PTL 1, for example, is used to solve a situation in which a strong axial thrust is generated in a direction of a pump suction port in an impeller due to the unbalance between pressure distributions in front and back of the impeller. This centrifugal fluid machine is a centrifugal fluid machine including an impeller obtained by boring a plurality of flow holes that pass through the inside of an impeller body radially from an impeller suction port that opens to a central portion on one side of a disk-shaped impeller body, and having an orifice portion of an annular gap formed between the impeller suction port and a pump case. In this centrifugal fluid machine, a pressure-equalizing hole penetrating in the axial direction without intersecting the flow holes is bored in the impeller body.

In the related art, for example, a centrifugal fluid machine (impeller of a centrifugal pump) described in PTL 2, is to improve suction performance without sacrificing pump performance. This centrifugal fluid machine is a centrifugal fluid machine in which an annular projection is provided on the back side of a rear shroud of an impeller to constitute a non-contact seal in conjunction with a casing, and a balance chamber is provided in a cavity inside the annular projection sandwiched between the rear shroud and the casing. In this centrifugal fluid machine, the balance chamber and a suction side of a impeller boss portion communicate with each other via a continuity hole provided in a center portion of the impeller, and a flow path that opens toward the downstream side on a conical surface on the suction side of the impeller.

CITATION LIST

Patent Literature

[PTL 1] Japanese Unexamined Utility Model Registration Application Publication No. 3-123999

[PTL 2] Japanese Examined Patent Application Publication No. 63-16598

SUMMARY OF INVENTION

Technical Problem

The centrifugal fluid machine described in the above-described PTL 1 provides the axial thrust balancing mechanism that reduces the axial thrust and solves the unbalance between the pressure distributions before and behind (axial direction) the impeller. In the centrifugal fluid machine described in the above-described PTL 2, in addition to the axial thrust balancing mechanism, a leaked fluid to the balance chamber is made to flow out to the suction side of the impeller in the same direction as a sucked fluid of the impeller, and a pressure drop on the suction side of the impeller is prevented. However, if the flow velocity of a fluid on the suction side of the impeller is different from the flow velocity of a fluid that flows out from the flow holes to the suction side of the impeller, a mixing loss resulting from the speed difference is caused.

The invention is provided so as to solve the above-described problem, and an object of the invention is to provide a centrifugal fluid machine that can maintain axial thrust balance, can prevent drop in pressure of an impeller on a suction side, and can reduce the mixing loss of a fluid.

Solution to Problem

In order to achieve the above object, a centrifugal fluid machine of the invention includes a casing having a hollow shape; an impeller that is rotatably supported within the casing and has an annular member arranged on one side in an axial direction, a disk member arranged on the other side in the axial direction, and a plurality of blades provided side by side in a circumferential direction between the annular member and the disk member; a suction passage that allows a fluid to be sucked therethrough in the axial direction from the center of the annular member in the impeller with the rotation of the impeller; a discharge passage that allows a fluid delivered under pressure by the impeller with the rotation of the impeller to be discharged in a direction intersecting the axial direction of the impeller; and a flow path that communicates with the discharge passage and leads to the suction passage through a gap between the casing and at least one of the disk member and the annular member, and has an opening that opens toward the downstream side of the suction passage in a suction direction of a fluid. The opening area of the opening is set so that the ejection speed of a fluid ejected from the opening to the suction passage is matched with the suction speed of a fluid sucked into the suction passage.

According to this centrifugal fluid machine, since the opening opens to the downstream side of the suction passage in the suction direction of a fluid, axial thrust balance can be maintained, and a drop in the pressure of the impeller on the suction side can be prevented. Moreover, the opening area of the opening is set, and the ejection speed of a fluid ejected from the opening to the suction passage is matched with the suction speed of a fluid sucked into the suction passage. It is thus possible to reduce a mixing loss caused when a fluid joins the suction passage from the flow path. As a result, the pressure delivery efficiency of a fluid of the centrifugal fluid machine can be improved.

Additionally, in the centrifugal fluid machine of the invention, the opening of the flow path passing through the gap between the casing and the disk member is provided so as to incline with respect to a normal line passing an axis of the impeller so that the orientation of a fluid to be ejected is aligned with a fluid sucked into the suction passage with the rotation of the impeller.

According to this centrifugal fluid machine, the orientation of a fluid to be ejected is aligned with a fluid sucked into the suction passage with the rotation of the impeller by virtue of the orientation of the opening. Therefore, a mixing loss caused when a fluid joins the suction passage from the flow path can be further reduced. As a result, the pressure delivery efficiency of a fluid of the centrifugal fluid machine can be further improved.

Advantageous Effects of Invention

According to the invention, axial thrust balance can be maintained, a drop in pressure of the impeller on the suction side can be prevented, and the mixing loss of a fluid can be reduced.

DESCRIPTION OF EMBODIMENTS

Hereinafter, an embodiment related to the invention will be described in detail with reference to the drawings. In addition, the invention is not limited by this embodiment. Additionally, constituent elements in the following embodiment include elements capable of being easily substituted by a person skilled in the art, or substantially the same elements.

Figure 1:
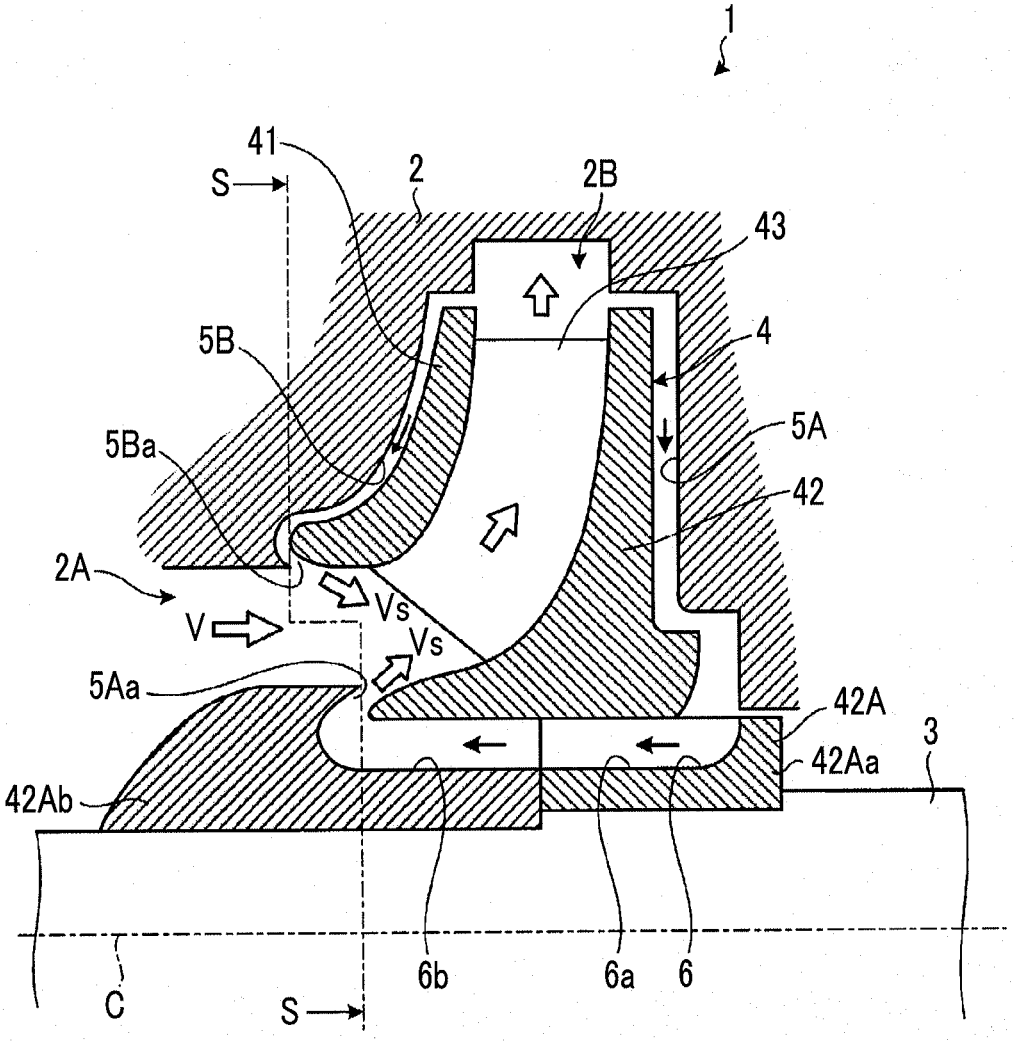
FIG. 1 is a view showing a portion of a side cross-section of a centrifugal fluid machine related to an embodiment of the invention.

FIG. 1 is a view showing a portion of a side cross-section of a centrifugal fluid machine related to the present embodiment. In addition, the "fluid" in the present embodiment may be liquid, gas, or supercritical fluid.

In a centrifugal fluid machine 1, as shown in FIG. 1, a casing 2 has a hollow shape and has a rotary shaft 3 rotatably supported by a bearing (not shown) at a central portion thereof. A drive unit (not shown) is coupled to an end portion of the rotary shaft 3. An impeller 4 is fixed to an outer peripheral portion of the rotary shaft 3. In addition, symbol C represents an axis serving as the rotation center of the rotary shaft 3 and the impeller 4. Additionally, the casing 2 and the impeller 4 are formed along a circumferential direction about the rotary shaft 3. However, in a side cross-section of FIG. 1, only one side (upper side in FIG. 1) of the casing and the impeller is shown and the other side (lower side in FIG. 1) thereof is omitted.

The impeller 4 is constituted by a front shroud 41 as an annular member that opens at the center thereof, a rear shroud 42 as a disk member, and a plurality of blades 43 fixed so as to be sandwiched between the front shroud 41 and the rear shroud 42. The front shroud 41 and the rear shroud 42 are provided side by side along an extending direction of the rotary shaft 3.

The rear shroud 42 has a boss portion 42A fixed to the rotary shaft 3, and is provided to extend toward a radial outer side from the boss portion 42A. The rear shroud 42 is formed so that the surface of the rear shroud on the side of the front shroud 41 on which the blades 43 are provided gradually approaches the front shroud 41 side as approaching the rotary shaft 3.

The front shroud 41 is provided so as to be supported by the rear shroud 42 via the blades 43, and is arranged apart from the rotary shaft 3. The front shroud 41 is formed so that the surface of the front shroud on the side of the rear shroud 42 on which the blades 43 are provided is gradually distant from the rear shroud 42 side as approaching the rotary shaft 3. A portion between opposed surfaces on which the blades 43 are provided between the front shroud 41 and the rear shroud 42 opens toward a front side (left side of FIG. 1) that is an extending direction of the rotary shaft 3, on a side near the rotary shaft 3, and opens toward the radial outer side (upper side of FIG. 1) of the rotary shaft 3, on a side away from the rotary shaft 3.

The plurality of blades 43 are fixed to the respective opposed surfaces of the rear shroud 42 and the front shroud 41 between the rear shroud 42 and the front shroud 41, and are provided side by side at predetermined intervals in the circumferential direction. Accordingly, the impeller 4 is rotatably supported within the casing 2 together with the rotary shaft 3. The impeller 4 itself rotates with the rotation of the rotary shaft 3 to thereby introduce a fluid from the front side, and compresses and pressurizes the fluid to deliver the fluid under pressure to the radial outer side that is an outer peripheral side.

The casing 2 is formed with a suction passage 2A through which a fluid is sucked along the axial direction of the impeller 4, and the fluid is allowed to be introduced to the front shroud 41 side in the impeller 4 via the suction passage 2A. Additionally, a discharge passage 2B for discharging a fluid delivered under pressure by the impeller 4 is formed along the outer peripheral side of the impeller 4 in the casing 2. An outer peripheral portion of the discharge passage 2B is formed with a discharge port (not shown) that discharges a fluid to the outside.

Accordingly, if the rotary shaft 3 is rotated by the drive unit (not shown), the impeller 4 rotates and a fluid is sucked into the casing 2 through the suction passage 2A. Then, this fluid rises in pressure in the process of flowing through the rotating impeller 4, is then discharged to the discharge passage 2B, and is discharged to the outside from the discharge port.

In the centrifugal fluid machine 1 configured in this way, as shown in FIG. 1, a first flow path 5A and a second flow path 5B are provided.

The first flow path 5A is a flow path that communicates with the discharge passage 2B and approaches the rotary shaft 3 through a gap formed between the casing 2 and the rear shroud 42, passes through the inside of the boss portion 42A, and leads to the suction passage 2A.

A through hole 6 is formed in the boss portion 42A in order to form the first flow path 5A. The through hole 6 forms a portion of the first flow path 5A, and is provided through the boss portion 42A along the axial direction that is the extending direction of the rotary shaft 3. In the present embodiment, the boss portion 42A is formed so as to be split into a rear boss portion 42Aa and a front boss portion 42Ab in order to form the through hole 6.

The through hole 6 is formed as a rear through hole 6*a* at the rear boss portion 42Aa, and a plurality of the through holes are provided side by side in the circumferential direction so that one end of each through hole opens toward the radial outer side of the rotary shaft 3 so as to communicate with a portion of the first flow path 5A communicating with the discharge passage 2B and approaching the rotary shaft 3 through the gap between the casing 2 and the rear shroud 42, each through hole passes through along the extending direction of the rotary shaft 3 from the portion of the first flow path, and the other end of each through hole is directed to the front boss portion 42Ab side.

Additionally, the through hole 6 is formed as a front through hole 6*b* at the front boss portion 42Ab, and forms a passage along the extending direction of the rotary shaft 3 in conjunction with the end portion of the rear shroud 42 on the rotary shaft 3 side. That is, the through hole can be obtained by forming an annular groove that is continuous in the circumferential direction in the front boss portion 42Ab. The front through hole 6*b* is formed so that one end opens so as to be directed to the rear boss portion 42Aa side and communicates with the other end of the rear through hole 6*a*, and the other end opens toward the suction passage 2A along the extending direction of the rotary shaft 3 from the other end of the rear through hole. The opening of the other end of the front through hole 6*b* is formed as an opening 5Aa where the first flow path 5A opens to the suction passage 2A. The opening 5Aa is formed so that the other end of the front through hole 6*b* goes around the end portion of the rear shroud 42 on the rotary shaft 3 side (front side), and is thereby formed toward a downstream side in a suction direction of a fluid in the suction passage 2A. In addition, although it is described that the first flow path 5A is a flow path that passes through the inside of the boss portion 42A in which the through hole 6 is formed, and leads to the suction passage 2A, the invention is not limited to this. For example, the through hole 6 may be formed not in the boss portion 42A but in the rotary shaft 3, and the first flow path may be a flow path that passes through the inside of the rotary shaft 3 in which the through hole 6 is formed, and leads to the suction passage 2A. Additionally, although it is described that the boss portion 42A is formed so as to be split into the rear boss portion 42Aa and the front boss portion 42Ab in order to form the through hole 6, the invention is not limited to this. For example, the through hole 6 may be formed by integral casting without splitting the boss portion 42A into the front and the rear.

The second flow path 5B is a flow path that communicates with the discharge passage 2B and leads to the suction passage 2A through a gap formed between the casing 2 and the front shroud 41. An opening of an end portion, which leads to the suction passage 2A, in the gap between the casing 2 and the front shroud 41, is formed as an opening 5Ba opening to the suction passage 2A. The opening 5Ba is formed so that a portion of the casing 2 goes around the end portion of the front shroud 41 on the rotary shaft 3 side (front side), and is thereby formed toward a downstream side in the suction direction of a fluid in the suction passage 2A.

Since pressure distributions within the first flow paths 5A and the second flow path 5B are different, an axial thrust acts on the impeller 4.

In the centrifugal fluid machine 1 of the present embodiment, the opening area of the opening 5Aa of the first flow path 5A and the opening 5Ba of the second flow path 5B is set so that the ejection speed of a fluid ejected to the suction passage 2A matches the suction speed of the fluid sucked into the suction passage 2A.

Specifically, the flow velocity of a fluid in the suction passage 2A is defined as V [m/s], and the flow velocity of a fluid ejected from the opening 5Aa or the opening 5Ba is defined as Vs [m/s]. It is assumed that the flow velocity V includes a swirling component when the impeller 4 rotates. Meanwhile, if the flow rate of a fluid ejected from the opening 5Aa or the opening 5Ba is defined as Q [$m^3$/s], the opening area of the opening 5Aa or the opening 5Ba is defined as A [$m^2$], and the swirling speed when the impeller 4 rotates in an outlet portion of the opening 5Aa or the opening 5Ba is defined as Vt [m/s], the flow velocity Vs of an outlet of the opening 5Aa or the opening 5Ba is Q/A. As a result, if the swirling speed Vt is taken into consideration, the flow velocity Vs is $((Q/A)^2+Vt^2)^{0.5}$. Since the flow rate Q and the swirling speed Vt are set so as to function as an axial thrust balancing mechanism, the opening area A of the opening 5Aa or the opening 5Ba may be set in order to match the ejection speed Vs of a fluid ejected from the opening 5Aa or the opening 5Ba to the suction passage 2A with the suction speed V of a fluid sucked into the suction passage 2A.

That is, the centrifugal fluid machine 1 of the present embodiment includes a casing 2 having a hollow shape; an impeller 4 that is rotatably supported within the casing 2 and has a front shroud (annular member) 41 arranged on one side in an axial direction, a rear shroud (disk member) 42 arranged on the other side in the axial direction, and a plurality of blades 43 provided side by side in a circumferential direction between the front shroud 41 and the rear shroud 42; a suction passage 2A that allows a fluid to be sucked therethrough in the axial direction from the center of the front shroud 41 in the impeller 4 with the rotation of the impeller 4; a discharge passage 2B that allows a fluid delivered under pressure by the impeller 4 with the rotation of the impeller 4 to be discharged in a direction intersecting the axial direction of the impeller 4; and a first flow path 5A that communicates with the discharge passage 2B and leads to the suction passage 2A through a gap between the casing 2 and the rear shroud 42, and has an opening 5Aa that opens toward the downstream side of the suction passage 2A in a suction direction of a fluid. Here, the opening area A of the opening 5Aa is set so that the ejection speed Vs of a fluid ejected from the opening 5Aa to the suction passage 2A is matched with the suction speed V of a fluid sucked into the suction passage 2A.

Additionally, the centrifugal fluid machine 1 of the present embodiment includes a casing 2 having a hollow shape; an impeller 4 that is rotatably supported within the casing 2 and has a front shroud (annular member) 41 arranged on one side in an axial direction, a rear shroud (disk member) 42 arranged on the other side in the axial direction, and a plurality of blades 43 provided side by side in a circumferential direction between the front shroud 41 and the rear shroud 42; a suction passage 2A that allows a fluid to be sucked therethrough in the axial direction from the center of the front shroud 41 in the impeller 4 with the rotation of the impeller 4; a discharge passage 2B that allows a fluid delivered under pressure by the impeller 4 with the rotation of the impeller 4 to be discharged in a direction intersecting the axial direction of the impeller 4; and a second flow path 5B that communicates with the discharge passage 2B, leads to the suction passage 2A through a gap between the casing 2 and the front shroud 41, and an opening 5Ba that opens toward the downstream side of the suction passage 2A in a suction direction of a fluid. Here, the opening area A of the opening 5Ba is set so that the ejection speed Vs of a fluid ejected from the opening 5Ba to the suction passage 2A is matched with the suction speed V of a fluid sucked into the suction passage 2A.

According to the centrifugal fluid machine 1 of the present embodiment, as the opening 5Aa or the opening 5Ba opens to the downstream side of the suction passage 2A in the suction direction of the fluid, the axial thrust can be reduced, and a drop in the pressure of the impeller 4 on the suction side can be prevented. Moreover, the opening area A of the opening 5Aa or the opening 5Ba is set, and the ejection speed Vs of a fluid ejected from the opening 5Aa or the opening 5Ba to the suction passage 2A is matched with the suction speed V of a fluid sucked into the suction passage 2A. It is thereby possible to reduce a mixing loss caused when a fluid joins the suction passage 2A from the first flow path 5A or the second flow path 5B. As a result, it is possible to improve the pressure delivery efficiency of a fluid of the centrifugal fluid machine 1. In addition, it is optimal to make the ejection speed Vs equal to the suction speed V. However, the suction speed V may change according to the operation state of the centrifugal fluid machine 1. Even in such a case, in order to reduce the mixing loss, at least the ejection speed Vs may set to be a range of ±50 [%] of the suction speed V, that is, if the opening area A of the opening 5Aa or the opening 5Ba is set so as to fall within a range of at least $0.5\ V \leq Vs \leq 1.5\ V$, the effect of improving the pressure delivery efficiency of a fluid of the centrifugal fluid machine 1 is obtained.

In addition, if the above configuration in which the opening area is set is applied to at least one of the opening 5Aa of the first flow path 5A and the opening 5Ba of the second flow path 5B, the above effect can be exhibited, and if the above configuration is applied to the opening 5Aa of the first flow path 5A and the opening 5Ba of the second flow path 5B, the above effect can be markedly obtained.

Figure 2:
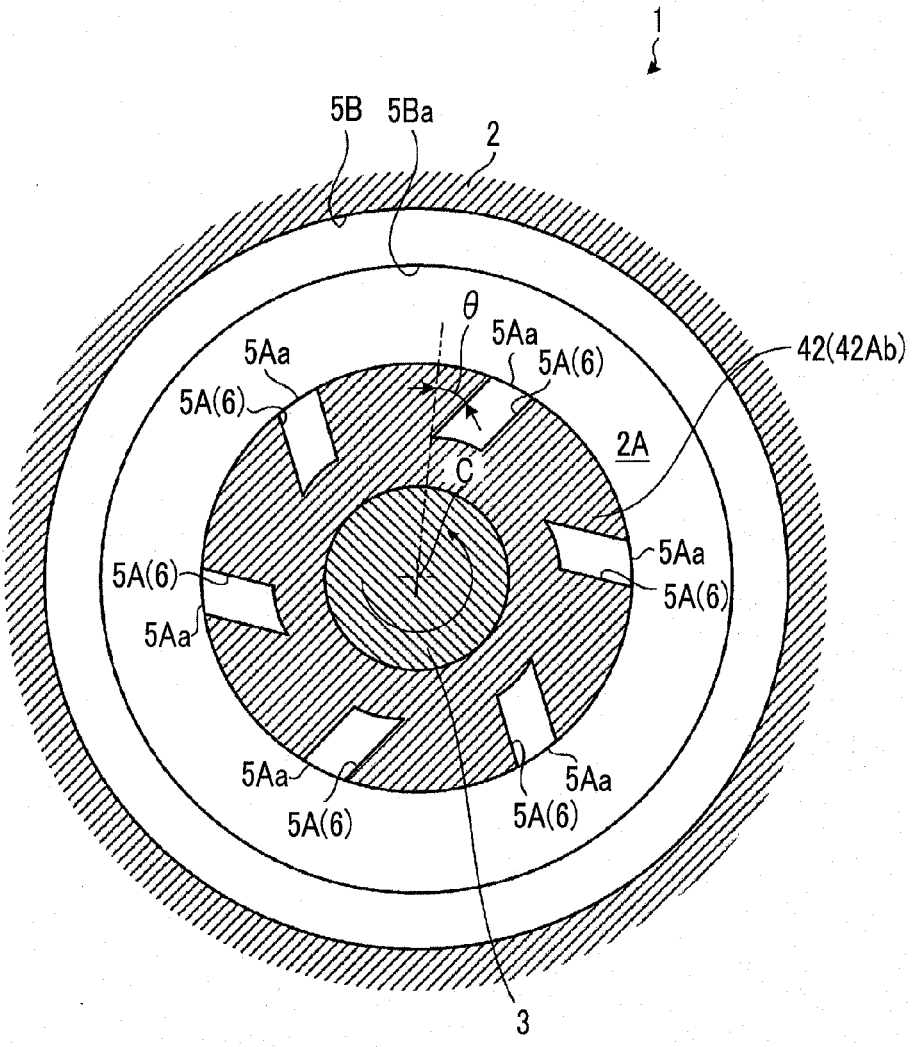
FIG. 2 is an S-S cross-sectional view in FIG. 1.

FIG. 2 is an S-S cross-sectional view in FIG. 1. As described above, since the ejection speed Vs is influenced by the swirling speed Vt, a fluid ejected from the opening 5Aa or the opening 5Ba flows obliquely toward a swirling direction. Accordingly, in the present embodiment, a fluid ejected from opening 5Aa is made to flow in the direction of the shaft C of the rotary shaft 3 by tilting the orientation of the opening 5Aa with respect to the rotational direction of the rotary shaft 3 (impeller 4) so as to slightly face the rotational direction. Specifically, the opening 5Aa is provided so as to incline at an angle θ with respect to a normal line passing through the axis C of the impeller 4, that is, the radiation direction of the axis C (radial direction of the impeller 4).

In this way, in the centrifugal fluid machine 1 of the present embodiment, the opening 5Aa is provided so as to incline with respect to the normal line passing the axis C of the impeller 4 so that the orientation of a fluid to be ejected is aligned with a fluid sucked into the suction passage 2A with the rotation of the impeller 4.

According to the centrifugal fluid machine 1 of the present embodiment, the orientation of a fluid to be ejected is aligned with a fluid sucked into the suction passage 2A with the rotation of the impeller 4 by virtue of the orientation of the opening 5Aa. Therefore, it is possible to further reduce a mixing loss caused when a fluid joins the suction passage 2A from the first flow path 5A. As a result, it is possible to further improve the pressure delivery efficiency of a fluid of the centrifugal fluid machine 1.

REFERENCE SIGNS LIST

1: CENTRIFUGAL FLUID MACHINE
2: CASING
2A: SUCTION PASSAGE
2B: DISCHARGE PASSAGE
3: ROTARY SHAFT
4: IMPELLER
41: FRONT SHROUD (ANNULAR MEMBER)
42: REAR SHROUD (DISK MEMBER)
42A: BOSS PORTION
42Aa: REAR BOSS PORTION
42Ab: FRONT BOSS PORTION
43: BLADE
5A: FIRST FLOW PATH (FLOW PATH)
5Aa: OPENING
5B: SECOND FLOW PATH (FLOW PATH)
5Ba: OPENING
6: THROUGH HOLE
6*a*: REAR THROUGH HOLE
6*b*: FRONT THROUGH HOLE
A: OPENING AREA
C: AXIS

The invention claimed is:

1. A centrifugal fluid machine comprising:

a casing having a hollow shape;

an impeller that is rotatably supported within the casing and has an annular member arranged on one side in an axial direction, a disk member arranged on another side in the axial direction, and a plurality of blades provided side by side in a circumferential direction between the annular member and the disk member;

a suction passage that allows a fluid to be sucked therethrough in the axial direction from a center of the annular member in the impeller with rotation of the impeller;

a discharge passage that allows the fluid delivered under pressure by the impeller with the rotation of the impeller to be discharged in a direction intersecting the axial direction of the impeller;

a first flow path that communicates with the discharge passage and leads to the suction passage through a gap between the casing and the disk member, and has a first opening that opens at an upstream side of the plurality of blades and toward a downstream side of the suction passage in a suction direction of the fluid; and a second flow path that communicates with the discharge passage and leads to the suction passage through a gap between the casing and the annular member, and has a second opening that opens at the upstream side of the plurality of blades and toward the downstream side of the suction passage in the suction direction of the fluid, wherein an opening area of the first opening and an opening area of the second opening are set so that an ejection speed of the fluid ejected from the first and second openings to the suction passage is matched with a suction speed of the fluid sucked into the suction passage.

2. The centrifugal fluid machine according to claim 1, wherein the first opening of the flow path passing through the gap between the casing and the disk member is provided so as to incline with respect to a normal line passing an axis of the impeller so that an orientation of the fluid to be ejected is aligned with the fluid sucked into the suction passage with the rotation of the impeller.

* * * * *